US009091980B2

(12) United States Patent
Egi

(10) Patent No.: US 9,091,980 B2
(45) Date of Patent: Jul. 28, 2015

(54) FIXING DEVICE AND IMAGE FORMING APPARATUS

(71) Applicant: KYOCERA Document Solutions Inc., Osaka (JP)

(72) Inventor: Makoto Egi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/305,440

(22) Filed: Jun. 16, 2014

(65) Prior Publication Data

US 2014/0376979 A1 Dec. 25, 2014

(30) Foreign Application Priority Data

Jun. 20, 2013 (JP) ..... 2013-129456

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
USPC ..... 399/107, 110, 122, 320, 328, 329
See application file for complete search history.

(56) References Cited

U.S. PATENT DOCUMENTS 6,014,539 A 1/2000 Sano et al.
2011/0135355 A1* 6/2011 Baba ..... 399/329

FOREIGN PATENT DOCUMENTS

JP H10-48977 A 2/1998

* cited by examiner

*Primary Examiner* — Hoan Tran
(74) *Attorney, Agent, or Firm* — Studebaker & Brackett PC

(57) ABSTRACT

A fixing device includes a fixing belt, a pressuring rotation body, a cap member and an elastic member. The cap member includes a main body part covering an outside of an end part of the fixing belt and a flange part covering an external diameter side of the end part. The elastic member includes a belt insertion part into which the end part is inserted, a cap insertion part into which the flange part is inserted and a contact part coming into contact with an internal side face of the main body part. When the fixing belt is deformed to an internal diameter side, the elastic member is elastically deformed to make the belt insertion part moved to the internal diameter side, and then, a gap is formed in at least a part between the internal side face of the main body part and the contact part.

18 Claims, 11 Drawing Sheets

FIXING DEVICE AND IMAGE FORMING APPARATUS

INCORPORATION BY REFERENCE

This application is based on and claims the benefit of priority from Japanese Patent application No. 2013-129456 filed on Jun. 20, 2013, the entire contents of which are incorporated herein by reference.

BACKGROUND

The present disclosure relates to a fixing device fixing a toner image on a recording medium and an image forming apparatus including the fixing device.

An electrographic image forming apparatus, such as a printer or a copying machine, forms a toner image on a surface of a recording medium, such as a sheet, and then, heats and pressures the recording medium and toner image by a fixing device, thereby fixing the toner image on the recording medium.

As a manner applied in the above-mentioned fixing device, a manner forming a fixing nip heating and pressuring the recording medium and toner image by a fixing roller and a pressuring roller is known. The above-mentioned fixing roller is formed, for example, by covering the outer circumference face of a cored bar made of metal by a resin having high toner releasability. As a heat source heating the above-mentioned fixing roller, for example, a halogen heater is used. The halogen heater is arranged, for example, inside the cored bar of the fixing roller.

On the other hand, another manner (so-called as an "IH (Induction Heating) manner") using an IH coil as the heat source instead of the halogen heater is known. The above-mentioned IH coil produces magnetic field by conducting electricity. In such an IH manner-type fixing device, instead of forming the fixing nip by the fixing roller and pressuring roller, the fixing nip is often formed by a fixing belt and the pressuring roller. The above-mentioned fixing belt is made of a rotatable endless belt. The magnetic field produced by the above-mentioned IH coil acts on the fixing belt so as to produce eddy current, thereby generating heat in the fixing belt.

As a rotating manner of the fixing belt, a manner rotating the fixing belt together with one or more rollers arranged at an internal diameter side of the fixing belt is known. On the other hand, another manner sliding the fixing belt with respect to a pressuring member arranged at the internal diameter side of the fixing belt is also known.

In the fixing device with such a manner, the fixing belt may be biased to one side in a rotation axis direction due to a gap of alignment of components of the fixing device, variation of temperature in the fixing device or other cause. Restriction of such a bias of the fixing belt is one of important tasks.

As a configuration achieving such an task, there is a configuration suppressing the bias of the fixing belt by holding an end part of the fixing belt by a resin member (e.g., a resin cap or a resin ring) and restricting movement of the above-mentioned resin member in the rotation axis direction of the fixing belt. However, if such a configuration is applied, there are possibilities that, since the end part of the fixing belt and resin member are rubbed, a crack in the end part of the fixing belt is caused and the resin member is scraped.

By contrast, there is a fixing device including a cap member attached to the end part of the fixing belt and an elastic member interposed between the fixing belt and cap member.

A first problem of the fixing device having such a configuration will be explained with reference to FIG. 10. In a configuration as shown in FIG. 10, a part of the cap member 102 is inserted into an internal diameter side of the fixing belt 101, and then, the elastic member 103 is interposed between the fixing belt 101 and cap member 102. In such a configuration, if deformation of the fixing belt 101 to the internal diameter side is attempted according to pressure (refer to an arrow a in FIG. 10) from the pressuring roller, the fixing belt 101 is not deformed more than a pressure deformation amount (refer to an arrow b in FIG. 10) of the elastic member 103. Therefore, it is difficult to respond to a case where great deformation of the fixing belt 101 to the internal diameter side is desired, i.e., a case where widening of width of the fixing nip is desired.

Next, a second problem of the fixing device having the above-mentioned configuration will be explained with reference to FIG. 11. In the configuration shown in FIG. 11, an external diameter side of the fixing belt 101 is covered by a part of the cap member 102 and the elastic member 103 is interposed between the fixing belt 101 and cap member 102. If such a configuration is applied, since the deformation of the fixing belt 101 to the internal diameter side is not restricted, the pressure deformation amount of the fixing belt 101 may be sufficiently secured.

However, biased force (refer to an arrow c in FIG. 11) to one side in the rotation axis direction is added to the fixing belt 101, and then, the elastic member 103 is pressured to the cap member 102 by this force. Therefore, when the fixing belt 101 after passing through the fixing nip is restored to the external diameter side, a catch occurs in a contact part (refer to an area surrounded by a circle d in FIG. 11) of the cap member 102 and elastic member 103 and the restoration of the fixing belt 101 to the external diameter side is obstructed.

SUMMARY

In accordance with an embodiment of the present disclosure, a fixing device includes a fixing belt, a pressuring rotation body, a cap member and an elastic member. The fixing belt rotates around a rotation axis. The pressuring rotation body comes into pressure contact with the fixing belt to form a fixing nip. The cap member is attached to an end part of the fixing belt. The cap member includes a main body part and a flange part. The main body part covers the outside in the rotation axis direction of the end part of the fixing belt. The flange part is extended from the main body part to the inside in the rotation axis direction and covers an external diameter side of the end part of the fixing belt. The elastic member is interposed between the end part of the fixing belt and the cap member. The elastic member includes a belt insertion part, a cap insertion part and a contact part. Into the belt insertion part, the end part of the fixing belt is inserted. The cap insertion part is arranged at the external diameter side from the belt insertion part. Into the cap insertion part, the flange part is inserted. The contact part is arranged at the outside in the rotation axis direction from the belt insertion part and cap insertion part. The contact part comes into contact with an internal side face in the rotation axis direction of the main body part. When the fixing belt is deformed to an internal diameter side, the elastic member is elastically deformed so as to make the belt insertion part moved to the internal diameter side with respect to the cap insertion part, and then, a gap is formed in at least a part between the internal side face in the rotation axis direction of the main body part and the contact part.

In accordance with an embodiment of the present disclosure, an image forming apparatus includes a fixing device.

The fixing device includes a fixing belt, a pressuring rotation body, a cap member and an elastic member. The fixing belt rotates around a rotation axis. The pressuring rotation body comes into pressure contact with the fixing belt to form a fixing nip. The cap member is attached to an end part of the fixing belt. The cap member includes a main body part and a flange part. The main body part covers the outside in the rotation axis direction of the end part of the fixing belt. The flange part is extended from the main body part to the inside in the rotation axis direction and covers an external diameter side of the end part of the fixing belt. The elastic member is interposed between the end part of the fixing belt and the cap member. The elastic member includes a belt insertion part, a cap insertion part and a contact part. Into the belt insertion part, the end part of the fixing belt is inserted. The cap insertion part is arranged at the external diameter side from the belt insertion part. Into the cap insertion part, the flange part is inserted. The contact part is arranged at the outside in the rotation axis direction from the belt insertion part and cap insertion part. The contact part comes into contact with an internal side face in the rotation axis direction of the main body part. When the fixing belt is deformed to an internal diameter side, the elastic member is elastically deformed so as to make the belt insertion part moved to the internal diameter side with respect to the cap insertion part, and then, a gap is formed in at least apart between the internal side face in the rotation axis direction of the main body part and the contact part.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Figure 1:
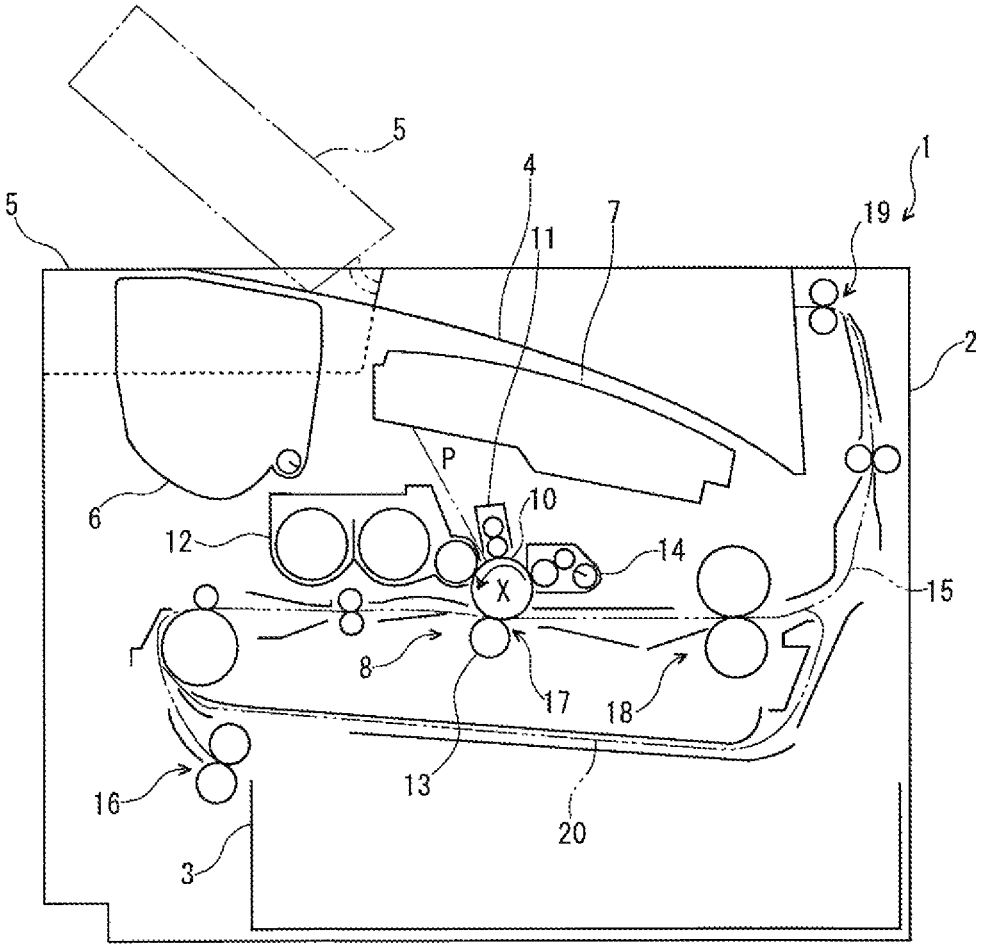
FIG. 1 is a schematic diagram schematically showing a printer according to a first embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, a sheet ejected tray 4 is formed. To top face of the printer main body 2, an upper cover 5 is openably/closably attached at the side of the sheet ejected tray 4 and, below the upper cover 5, a toner container 6 is installed.

In an upper part of the printer main body 2, an exposure device 7 composed of a laser scanning unit (LSU) is located below the sheet ejected tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeder 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electric-charged by the charger 11. Then, exposure corresponding to the image data on the photosensitive drum 10 is carried out by a laser light (refer to a two-dot chain line P in FIG. 1) from the exposure device 7, thereby forming an electrostatic latent image on the surface of the photosensitive drum 10. Subsequently, the development device 12 develops the electrostatic latent image by a toner (a developer).

On the other hand, a sheet fed from the sheet feeding cartridge 3 by the sheet feeder 16 is conveyed to the transferring part 17 in a suitable timing for the above-mentioned image forming operation, and then, the toner image carried on the photosensitive drum 10 is transferred onto the sheet in the transferring part 17. The sheet with the transferred toner image is conveyed to a downstream side in the conveying path 15 to go forward to the fixing device 18, and then, the toner image is fixed on the sheet in the fixing device 18. The sheet with the fixed toner image is ejected from the sheet ejecting part 19 to the sheet ejected tray 4. The toner remained on the photosensitive drum 10 is collected by the cleaning device 14.

Next, the fixing device 18 will be described in detail with reference to FIGS. 2-5.

Hereinafter, it will be described so that the front side of the fixing device 18 is positioned at the near side of FIG. 2, for convenience of explanation. An arrow Fr in FIG. 3 indicates the front side of fixing device 18. An arrow I in FIG. 3 indicates the inside in forward and backward directions and an arrow O in FIG. 3 indicates the outside in the forward and backward directions.

Figure 2:
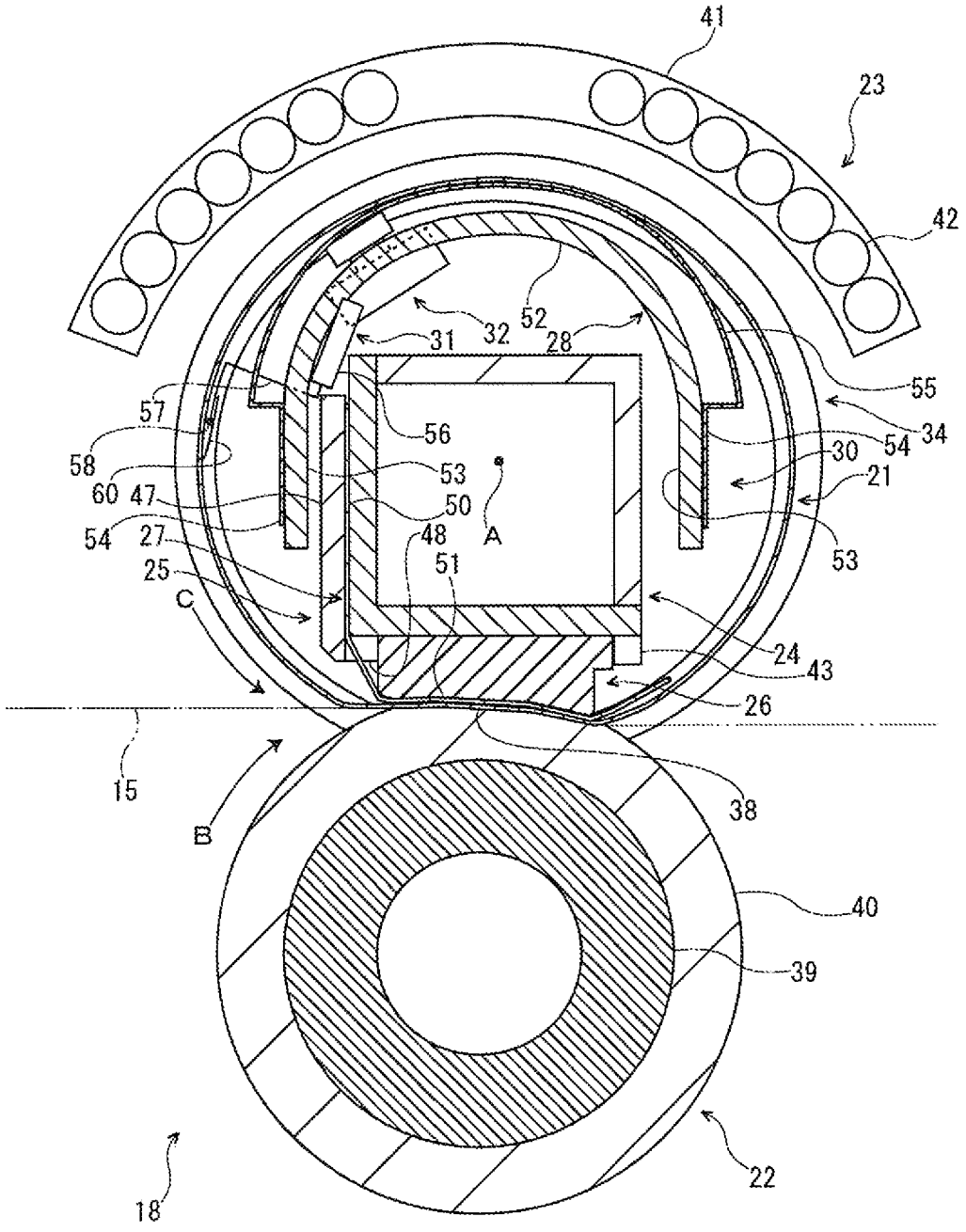
FIG. 2 is a sectional view showing a fixing device of the printer according to the first embodiment of the present disclosure.
Figure 3:
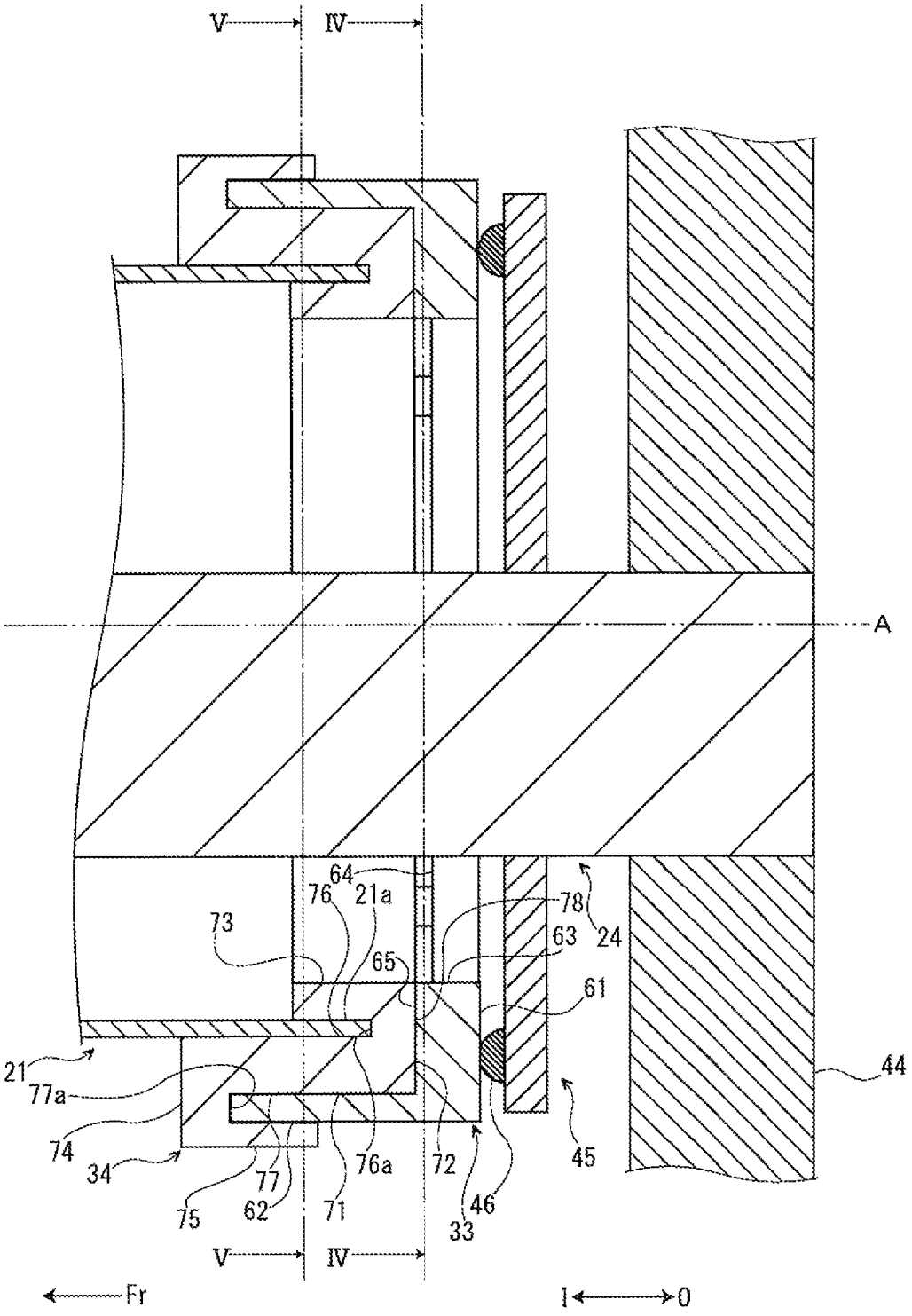
FIG. 3 is a side sectional view showing a rear end part of a fixing belt and the periphery in the fixing device of the printer according to the first embodiment of the present disclosure.

As shown in FIGS. 2 and 3, the fixing device 18 includes a fixing belt 21, a pressuring roller 22 (a pressuring rotation body), an IH (Induction Heating) fixing unit 23, a supporting member 24, a reinforcement member 25, a pressing pad 26 (a pressing member), a slide contacting member 27, a magnetism shielding member 28, a guide member 30, thermistors 31 (a temperature detecting part), a thermal insulating part 32 (a so-called thermo-cut), cap members 33 and elastic members 34. The pressuring roller 22 is positioned below the fixing belt 21. The IH fixing unit 23 is positioned above the fixing belt 21. The supporting member 24 is positioned at an internal diameter side of the fixing belt 21. The reinforcement member 25 is positioned at the internal diameter side of the fixing belt 21 and at the left side of the supporting member 24. The pressing pad 26 is positioned at the internal diameter side of the fixing belt 21 and at the downward side of the supporting member 24. The slide contacting member 27 is positioned at the internal diameter side of the fixing belt 21 and from the left side to the downward side in the supporting member 24 and pressing pad 26. The magnetism shielding member 28 is positioned at the internal diameter side of the fixing belt 21 and at the upward side of the supporting member 24. The guide member 30 is positioned at the internal diameter side of the fixing belt 21 and at the upward side of the magnetism shielding member 28. The thermistors 31 are positioned at the internal diameter side of the fixing belt 21 and at the left side of the supporting member 24. The thermal insulating part 32 is positioned at the internal diameter side of the fixing belt 21 and at the left upward side of the supporting member 24. The cap members 33 are attached to end parts 21*a* of the fixing belt 21. Each elastic member 34 is interposed between the end part 21*a* of the fixing belt 21 and cap member 33. In the embodiment, the end parts 21*a* of the fixing belt 21 are both end parts in the forward and backward directions of the fixing belt 21.

The fixing belt 21 is an endless thin belt having flexibility and is formed in a cylindrical shape elongated in the forward and backward directions. The fixing belt 21 is arranged to rotate around a rotation axis A extended in the forward and backward directions. That is, in the embodiment, a rotation axis direction of the fixing belt 21 is equal to the forward and backward directions.

The fixing belt 21 is composed of, for example, a base material layer and a release layer covering the base material layer. The base material layer of the fixing belt 21 is made of, for example, metal, such as nickel or stainless, or resin, such as polyimide (PI). The release layer of the fixing belt 21 is made of, for example, fluorine-based resin, such as perfluoro alkoxy alkane (PFA). The fixing belt 21 may have an elastic layer between the base material layer and release layer. The elastic layer is made of, for example, a silicone rubber.

The pressuring roller 22 is formed in a cylindrical shape elongated in the forward and backward directions. As shown in FIG. 2, the pressuring roller 22 comes into pressure contact with the fixing belt 21 and a fixing nip 38 is formed between the fixing belt 21 and pressuring roller 22. When the sheet is passed through the fixing nip 38, the sheet and toner image is heated and pressured, and then, the toner image is fixed to the sheet.

The pressuring roller 22 is rotatably supported by a fixing frame (not shown). The pressuring roller 22 is connected with a drive source (not shown), such as a drive motor. The pressuring roller 22 is composed of, for example, a cylindrical cored bar 39, an elastic layer 40 provided around the cored bar 39 and a release layer (not shown) covering the elastic layer 40. The cored bar 39 of the pressuring roller 22 is made of, for example, metal, such as stainless or aluminum. The elastic layer 40 of the pressuring roller 22 is made of, for example, a silicone rubber or a silicone sponge. The release layer of the pressuring roller 22 is made of, for example, fluorine-based resin, such as PFA.

As shown in FIG. 2, the IH fixing unit 23 includes a case member 41 and an IH coil 42 (a heat source) installed in the case member 41. The IH coil 42 is positioned at the external diameter side of the fixing belt 21 and arranged in an arc-like form along the outer circumference of the fixing belt 21.

The supporting member 24 is extended in the forward and backward directions to penetrate the fixing belt 21. The supporting member 24 is made, for example, by combining a pair of L-shaped metal plates and has a rectangular sectional shape. In a right lower corner part of the supporting member 24, a supporting protrusion 43 is provided to protrude to the downward side.

As shown in FIG. 3, both end parts in the forward and backward directions of the supporting member 24 are fixed to fixing members 44 respectively arranged at the front side and rear side of the fixing belt 21. The fixing members 44 are, for example, fixed to a fixing frame (not shown) or constitute a part of the fixing frame.

To both end parts in the forward and backward directions of the supporting member 24, ring-like formed bias stopping members 45 are fixed. The bias stopping members 45 are positioned at the internal side in the forward and backward directions from the respective fixing members 44. In faces at the internal side in the forward and backward directions of the bias stopping members 45, annular protruding parts 46 are respectively arranged.

As shown in FIG. 2, the reinforcement member 25 has a roughly L-shaped section and includes a first reinforcement part 47 extending in upward and downward directions and a second reinforcement part 48 bent from the lower end of the first reinforcement part 47 to the right side.

The pressing pad 26 is extended in the forward and backward directions. Atop face of the pressing pad 26 is fixed to a bottom face of the supporting member 24. Thereby, the pressing pad 26 is supported by the supporting member 24. A bottom face of the pressing pad 26 presses the fixing belt 21 from the internal diameter side to the downward side (to the side of the pressuring roller 22). The pressing pad 26 is inserted between the supporting protrusion 43 of the supporting member 24 and the second reinforcement part 48 of the reinforcement member 25.

The slide contacting member 27 has, for example, a sheet-like shape. The slide contacting member 27 includes a first contact part 50 extending in the upward and downward directions and a second contact part 51 bent from the lower end of the first contact part 50 to the right side. The first contact part 50 is inserted between a left side part of the supporting member 24 and the first reinforcement part 47 of the reinforcement member 25. The second contact part 51 is inserted between the bottom face of the pressing pad 26 and the fixing belt 21. When the fixing belt 21 is rotated, the fixing belt 21 slides with respect to the pressing pad 26 and second contact part 51. The fixing device 18 of the embodiment is configured to apply a so-called "slide belt manner".

The magnetism shielding member 28 includes a curved plate part 52 curved in an arc-like form to the upward side and flat plate parts 53 extending from the both end parts in left and right directions of the curved plate part 52 to the downward side. The magnetism shielding member 28 is made of, for example, nonmagnetic material with excellent electric conductivity, such as oxygen free copper. The magnetism shielding member 28 prevent a magnetic field produced by the IH coil 42 from passing through the supporting member 24.

The guide member 30 is arranged so as to cover the upper side of the magnetism shielding member 28. The guide member 30 is made of, for example, a magnetic body. The guide member 30 has a function generating heat by the action of the magnetic field produced by the IH coil 42 to heat the fixing belt 21. The guide member 30 includes attachment parts 54 attached to the flat plate parts 53 of the magnetism shielding member 28 and a connection part 55 curved in an arc-like form to the upward side and connecting the attachment parts 54. The connection part 55 guides (strains) the fixing belt 21 from the internal diameter side.

A plurality of the thermistors 31 are arranged at intervals in the forward and backward directions. The thermistors 31 are respectively arranged at a sheet passing region (a region where a maximum size of the sheet is passed) and a non-sheet passing region (a region where a maximum size of the sheet is not passed) in the fixing belt 21. Each thermistor 31 includes a housing 56 fixed to the curved plate part 52 of the magnetism shielding member 28, a plate spring 57 having an end part attached to the housing 56 and a terminal 58 fixed to another end of the plate spring 57. The terminal 58 is pressured to an inner circumference face of the fixing belt 21 by given pressure of the plate spring 57. That is, in the thermistor 31 of the embodiment, a contact manner is applied. The terminal 58 is covered by a cover sheet 60.

The thermal insulating part 32 is fixed to the curved plate part 52 of the magnetism shielding member 28. The thermal insulating part 32 faces to the sheet passing region of the fixing belt 21 at an interval. The thermal insulating part 32 has a function stopping the production of the magnetic field from the IH coil 42 to prevent excessive temperature rise of the fixing belt 21 when the temperature of the sheet passing region of the fixing belt 21 becomes a predetermined value or more.

The cap member 33 is made of, for example, heat resistant resin, such as liquid crystal polymer or polyphenylene sulfide (PPS). As shown in FIG. 3, the cap member 33 includes a main body part 61 covering the outside in the forward and backward directions of the end part 21*a* of the fixing belt 21 and a cylindrical flange part 62 extending from an end part at the external diameter side of the main body part 61 to the inside in the forward and backward directions and covering the external diameter side of the end part 21*a* of the fixing belt 21.

Figure 4:
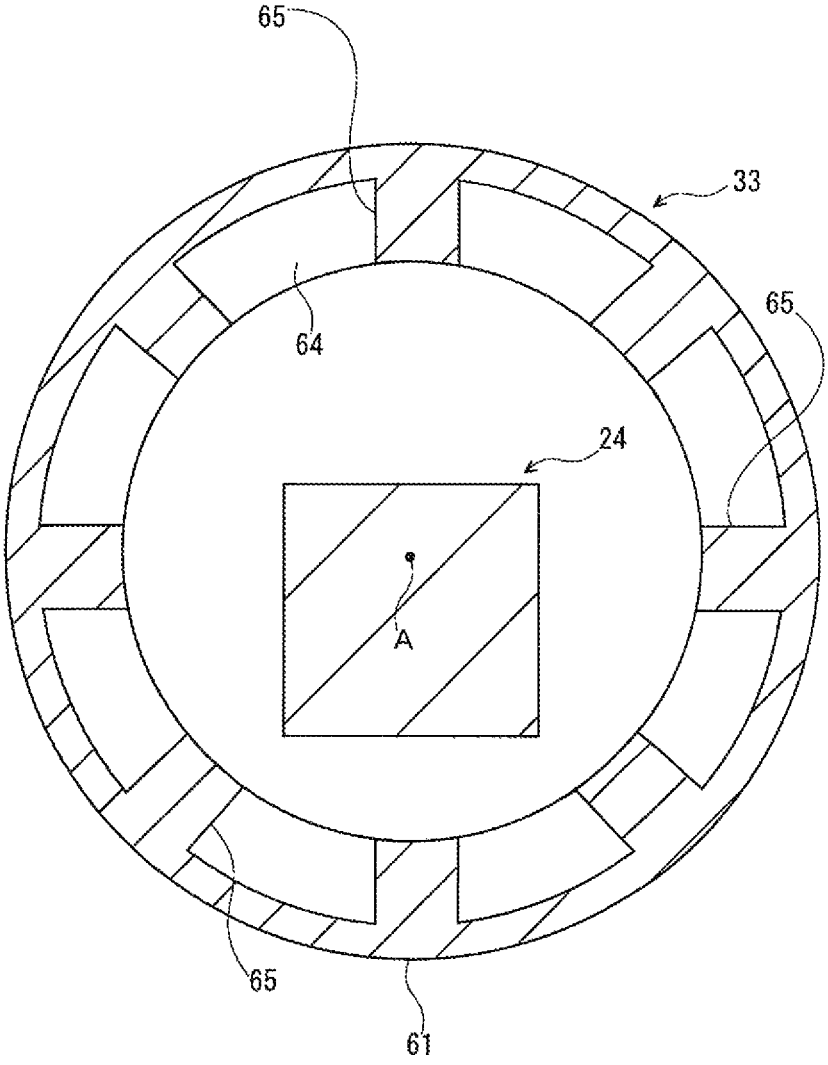
FIG. 4 is a sectional view taken along a line IV-IV of FIG. 3.
Figure 5:
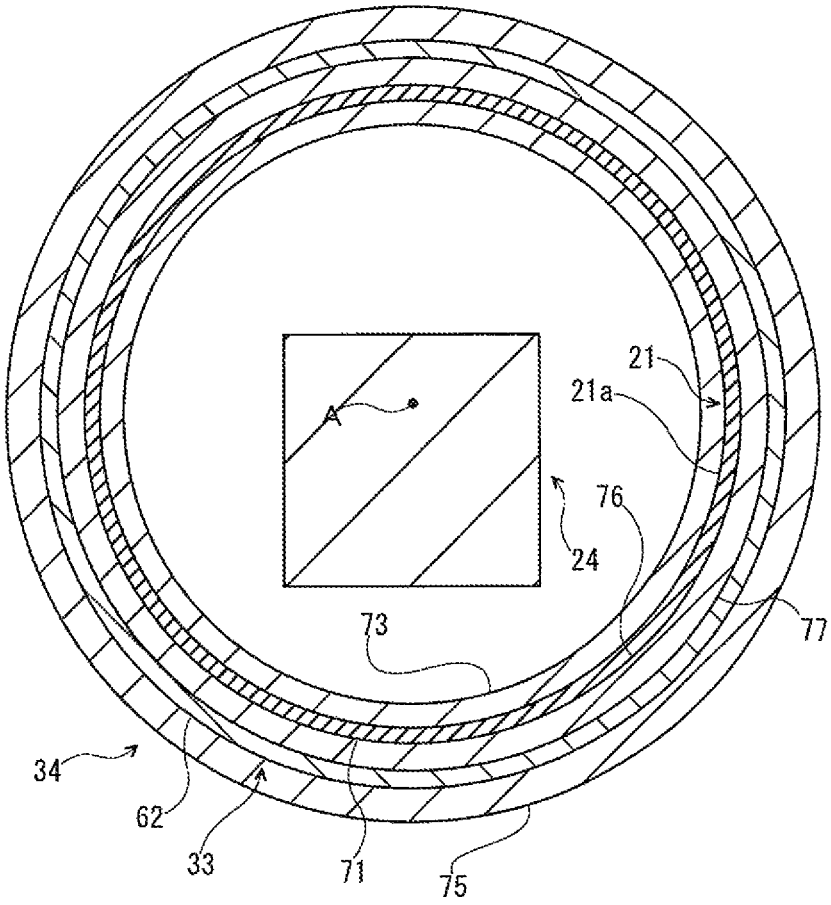
FIG. 5 is a sectional view taken along a line V-V of FIG. 3.

The main body part 61 of the cap member 33 is arranged roughly perpendicular to the rotation axis A of the fixing belt 21. In the main body part 61, a circular communication hole 63 is arranged in the forward and backward directions, and then, the supporting member 24 penetrates the communication hole 63. With an external side face in the forward and backward directions of the main body part 61, the protruding part 46 of the bias stopping member 45 comes into contact. Thereby, movement of the cap member 33 to the outside in the forward and backward directions is restricted. As shown in FIG. 4, in a face 64 (hereinafter, called as an "inside face 64") at the inside in the forward and backward directions of the main body part 61, a plurality of ribs 65 (e.g., eight ribs 65 in the embodiment) are projected. The plurality of the ribs 65 are arranged radially around the rotation axis A of the fixing belt 21.

As shown in FIG. 3, the flange part 62 of the cap member 33 is arranged in roughly parallel to the rotation axis A of the fixing belt 21. The flange part 62 is arranged at an interval from an outer circumference face of the fixing belt 21.

The elastic member 34 is made of, for example, a heat resistant rubber, such as a silicone rubber. The elastic member 34 includes a cylindrical first wall part 71, a second wall part 72, a third wall part 73, a fourth wall part 74 and a fifth wall part 75. The first wall part 71 is extending in the forward and backward directions. The second wall part 72 is bent from an end part at the outside in the forward and backward directions of the first wall part 71 to the internal diameter side. The third wall part 73 is bent from an end part at the internal diameter side of the second wall part 72 to the inside in the forward and backward directions. The fourth wall part 74 is bent from an end part at the inside in the forward and backward directions of the first wall part 71 to the external diameter side. The fifth wall part 75 is bent from an end part at the external diameter side of the fourth wall part 74 to the outside in the forward and backward directions. The first wall part 71 is inserted between the end part 21*a* of the fixing belt 21 and flange part 62 of the cap member 33.

In the elastic member 34, an annular belt insertion part 76 is formed so as to be surrounded by the first wall part 71, second wall part 72 and third wall part 73. The belt insertion part 76 is formed in a concave shape and opened to the inside in the forward and backward directions. Into the belt insertion part 76, the end part 21*a* of the fixing belt 21 is inserted. The belt insertion part 76 and end part 21*a* of the fixing belt 21 are not glued to each other.

In the elastic member 34, an annular cap insertion part 77 is formed so as to be surrounded by the first wall part 71, fourth wall part 74 and fifth wall part 75. The cap insertion part 77 is formed in a concave shape and opened to the outside in the forward and backward directions. Into the cap insertion part 77, the flange part 62 of the cap member 33 is inserted. The cap insertion part 77 and flange part 62 are not glued to each other. An end part 77*a* at the inside in the forward and backward directions of the cap insertion part 77 is arranged at the inside in the forward and backward directions from an end part 76*a* at the outside in the forward and backward directions of the belt insertion part 76. The cap insertion part 77 is arranged at the external diameter side from the belt insertion part 76 (refer to FIG. 5).

As shown in FIG. 3, in the elastic member 34, a contact part 78 is arranged on the outside face in the forward and backward directions of the second wall part 72. The contact part 78 is arranged at the outside in the forward and backward directions from the belt insertion part 76 and cap insertion part 77. The contact part 78 comes into contact with the plurality of the ribs 65 arranged in the inside face 64 of the main body part 61 of the cap member 33.

In the above-mentioned configuration, when the toner image is formed on the sheet, the drive source (not shown) works to rotate the pressuring roller 22 (refer to an arrow B in FIG. 2). When the pressuring roller 22 is thus rotated, the fixing belt 21 coming into pressure contact with the pressuring roller 22 is co-rotated in an opposite direction to the pressuring roller 22 (refer to an arrow C in FIG. 2). When the fixing belt 21 is thus rotated, each cap member 33 and each elastic member 34 are co-rotated by friction force between the end part 21*a* of the fixing belt 21 and each elastic member 34 and friction force between each elastic member 34 and each cap member 33. On the other hand, when the fixing belt 21 is rotated, the supporting member 24, pressing pad 26 and slide contacting member 27 are kept in stopping states.

In addition, when the toner image is formed on the sheet, high frequency current is flowed in the IH coil 42. According to this, the IH coil 42 produces the magnetic field, the action of the magnetic field produces eddy current to the fixing belt 21, and then, the heat is generated to the fixing belt 21. In such a situation, when the sheet is passed through the fixing nip 38, the sheet and toner image is heated and pressured, and then, the toner image is fixed on the sheet.

Figure 6:
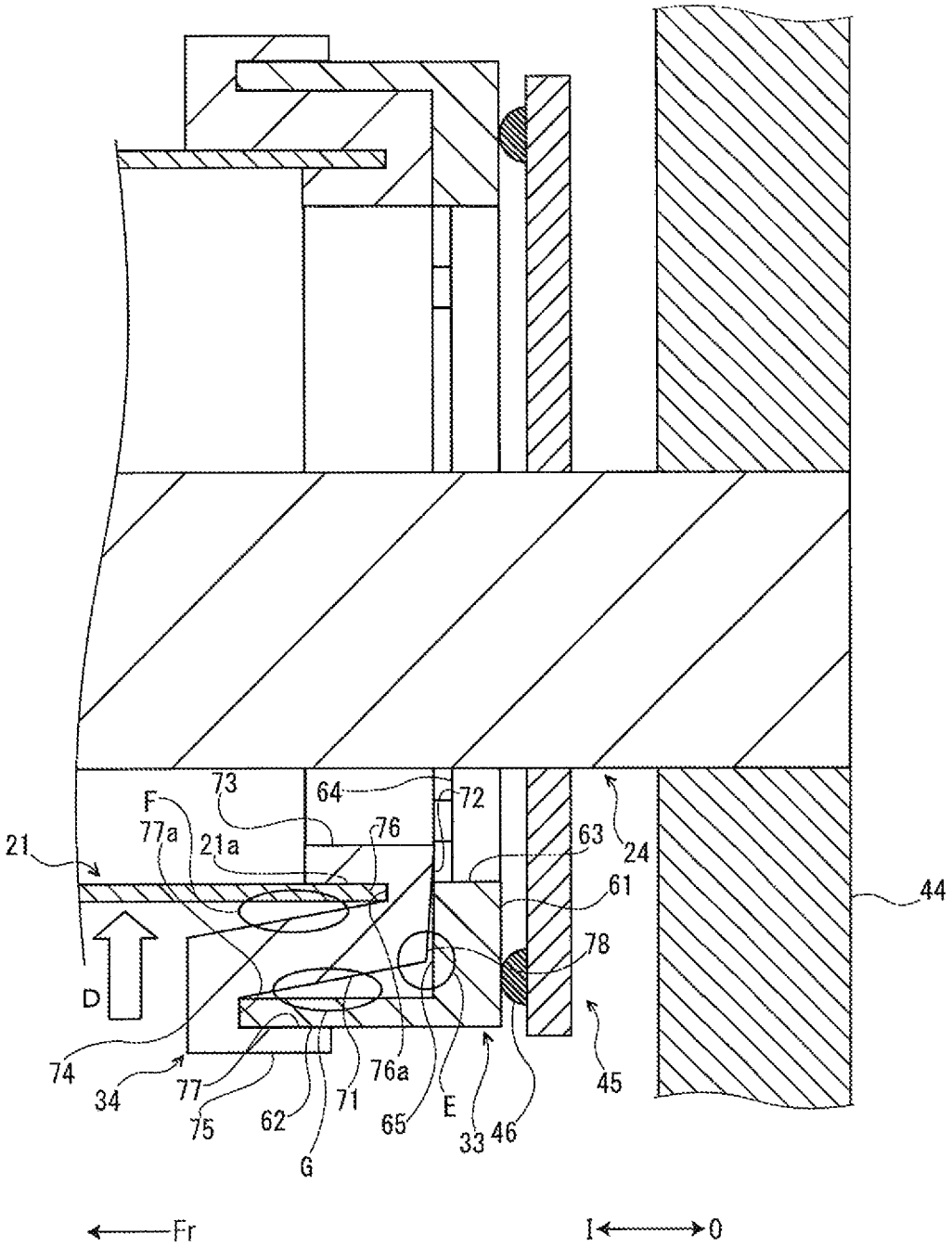
FIG. 6 is a side sectional view showing the fixing device in a situation in which the fixing belt is deformed to an internal diameter side of the printer according to the first embodiment of the present disclosure.

When the toner image is fixed on the sheet as mentioned above, when the fixing belt 21 is passed through the fixing nip 38, as indicated by avoid arrow D in FIG. 6, the pressuring roller 22 (not shown in FIG. 6) pressures the fixing belt 21 to the upper side. By this pressuring, when the fixing belt 21 is deformed to the internal diameter side, the elastic member 34 is elastically deformed so as to make the belt insertion part 76 moved to the internal diameter side with respect to the cap insertion part 77. According to this, the first wall part 71 of the elastic member 34 is inclined with respect to the forward and backward directions and the contact part 78 of the elastic member 34 is inclined with respect to the ribs 65 of the main body part 61 of the cap member 33, and then, a gap is formed between an external diameter side part of the contact part 78 and external diameter side parts of the ribs 65 (refer to an area surrounded by a circle E in FIG. 6).

Therefore, when the fixing belt 21 passed through the fixing nip 38 is restored to the external diameter side, a catch between the ribs 65 and the contact part 78 hardly occurs, and then, it is possible to smoothly restore the fixing belt 21 to the external diameter side. Moreover, since the gap is formed between the external diameter side part of the contact part 78 and the external diameter side parts of the ribs 65, it is possible to reduce friction between the contact part 78 and ribs 65. According to this, it is possible to suppress abrasion of the cap member 33 and elastic member 34.

When the fixing belt 21 is deformed to the internal diameter side as mentioned above, a gap is formed in a part between the belt insertion part 76 of the elastic member 34 and the end part 21*a* of the fixing belt 21 (refer to an area surrounded by a circle F in FIG. 6) and a gap is formed in a part between the cap insertion part 77 of the elastic member 34 and the flange part 62 of the cap member 33 (refer to an area surrounded by a circle G in FIG. 6). Therefore, it is possible to improve restoration force restoring the fixing belt 21 passed through the fixing nip 38 to the external diameter side.

As mentioned above, since the elastic member 34 is elastically deformed so as to make the belt insertion part 76 moved to the internal diameter side with respect to the cap insertion part 77, elastic force restoring the belt insertion part 76 to the external diameter side is caused in the elastic member 34. According to this, the fixing belt 21 passed through the fixing nip 38 is more easily restored to the external diameter side.

In the embodiment, the flange part 62 of the cap member 33 is arranged so as to cover the external diameter side of the end part 21*a* of the fixing belt 21. Therefore, the deformation of the fixing belt 21 to the internal diameter side is not restricted by the presence of the flange part 62, and then, it is possible to sufficiently secure a deformation amount of the fixing belt 21 to the internal diameter side. According to this, it is possible to respond to a case where great deformation of the fixing belt 21 to the internal diameter side is desired, i.e., a case where widening of width of the fixing nip 38 is desired.

The belt insertion part 76 is formed so as to be surrounded by the first wall part 71, second wall part 72 and third wall part 73. In addition, the cap insertion part 77 is formed so as to be surrounded by the first wall part 71, fourth wall part 74 and fifth wall part 75. Moreover, the contact part 78 is formed in the outside face in the forward and backward directions of the second wall part 72. By applying such a configuration, it is possible to form the belt insertion part 76, cap insertion part 77 and the contact part 78 in simple structures.

In the inside face 64 of the main body part 61, the radial ribs 65 are arranged. Therefore, it is possible to reduce contact area of the inside face 64 of the main body part 61 to the contact part 78. Thereby, it is possible to improve slidability of the inside face 64 of the main body part 61 to the contact part 78, and then, to effectively prevent occurrence of the catch between the inside face 64 of the main body part 61 and the contact part 78.

The fixing device 18 is configured to apply the so-called "slide belt manner" and to include the pressing pad 26 pressing the fixing belt 21 to the downward side (to the side of the pressuring roller 22) and the supporting member 24 supporting the pressing pad 26. Therefore, it is possible to reduce heat capacity of the fixing device 18 and to swiftly rise temperature of the fixing belt 21.

In the embodiment, the radial ribs 65 are arranged in the inside face 64 of the main body part 61, thereby improving the slidability of the inside face 64 of the main body part 61 to the contact part 78. However, in another embodiment, a ring-like cover sheet may be inserted between the inside face 64 of the main body part 61 and the contact part 78 in order to improve the slidability of the inside face 64 of the main body part 61 to the contact part 78.

In the embodiment, a case of applying the configuration of the present disclosure to the fixing device 18 having the so-called "slide belt manner" was described. However, in another embodiment, the configuration of the present disclosure may be applied to the fixing device having another manner rotating the fixing belt 21 together with one or more rollers arranged at the internal diameter side of the fixing belt 21.

In the embodiment, a case of inputting drive from the drive source (not shown) to the pressuring roller 22 was described. However, in another embodiment, the drive from the drive source may be inputted to the fixing belt 21 or the drive from the drive source may be inputted to both the pressuring roller 22 and fixing belt 21.

In the embodiment, a case of using the IH coil 42 as the heat source was described. However, in another embodiment, another heater, such as a halogen heater or a ceramic heater, may be used as the heat source.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

Second Embodiment

Next, the second embodiment of the present disclosure will be described with reference to FIGS. 7 and 8. An arrow Fr in FIG. 7 indicates the front side of fixing device 18. An arrow I in FIG. 7 indicates the inside in forward and backward directions and an arrow O in FIG. 7 indicates the outside in the forward and backward directions. Since other components except for a cap member 81 are configured in a similar way to the first embodiment, same reference numerals as the first embodiment are attached to the other components (particularly, in the figures) and the description of the other components is omitted. With regard to similar parts of the cap member 81 to the cap member 33 in the first embodiment, same reference numerals as the cap member 33 are attached (particularly, in the figures) and the description is omitted.

In the outer circumference part of the flange part 62 of the cap member 81, detected parts 82 are protruded. The outer circumference part of the flange part 62 corresponds to the outer circumference part of the entire cap member 81. As shown in FIG. 8, each detected part 82 is formed in a roughly fan-like shape. A plurality of the detected parts 82 (four detected parts 82 in the embodiment) are arranged at equal angular intervals (at intervals of 90 degrees in the embodiment).

Figure 7:
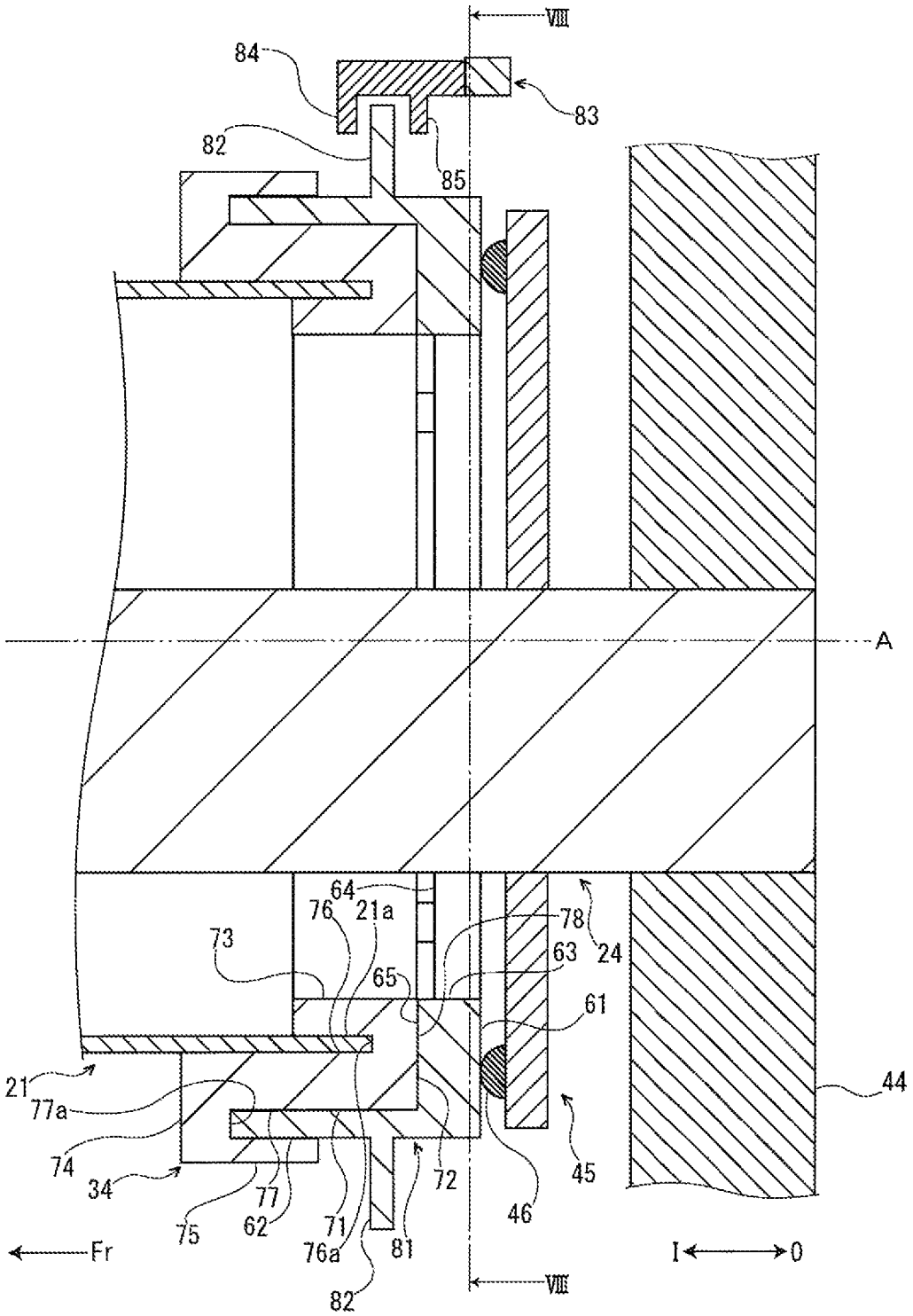
FIG. 7 is a side sectional view showing the rear end part of the fixing belt and the periphery in the fixing device of the printer according to a second embodiment of the present disclosure.
Figure 8:
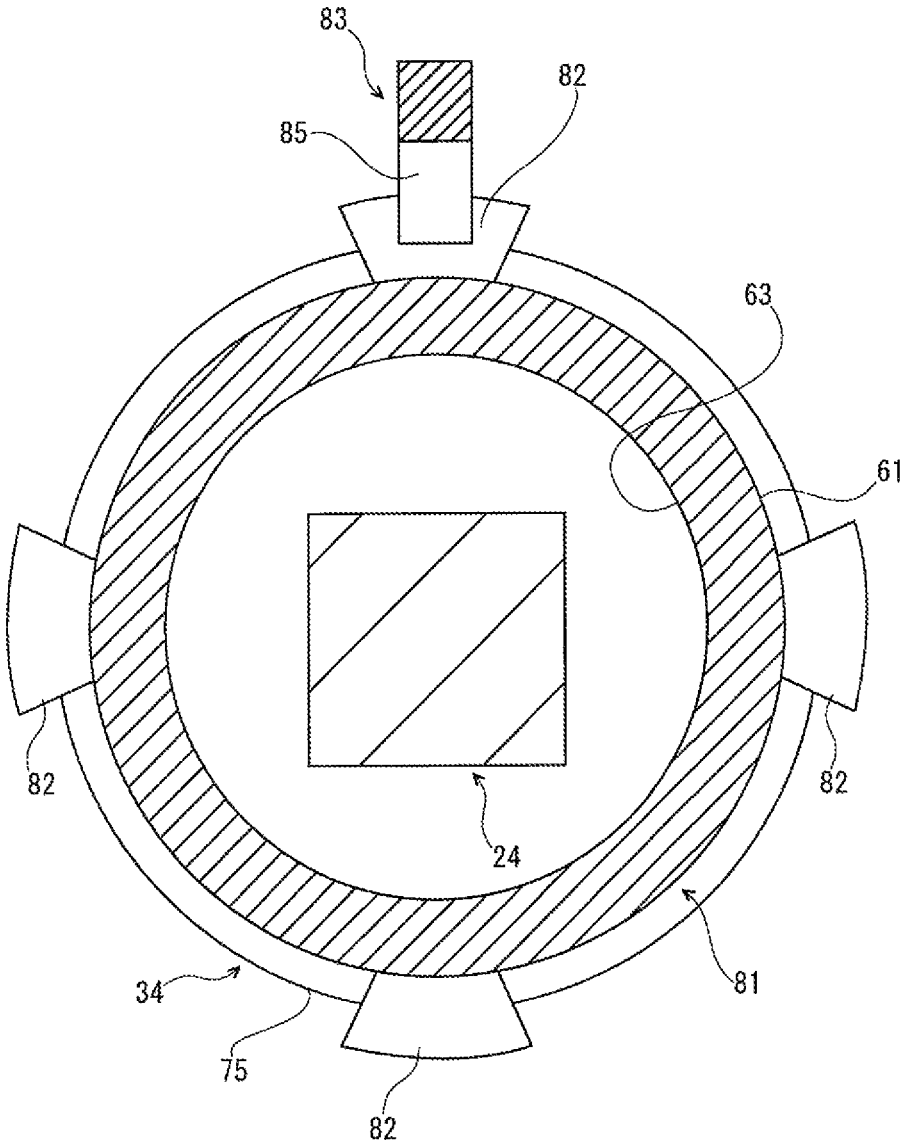
FIG. 8 is a sectional view taken along a line VIII-VIII of FIG. 7.

As shown in FIG. 7, above the flange part 62 of the cap member 81, a sensor 83 (a detecting part) is arranged. The sensor 83 is, for example, a photo interrupter (PI) sensor and includes a light emitting part 84 emitting light to the detected part 82 and a light receiving part 85 receiving the light from the light emitting part 84.

In a configuration as mentioned above, in a situation where the detected part 82 is not rotated, i.e., in a situation where the fixing belt 21, cap member 81 and elastic member 34 are not rotated, an optical path from the light emitting part 84 to the light receiving part 85 in the sensor 83 is not opened/closed by the detected part 82, and then, a received light amount is kept constant by High level or Low level. In such a case, it is possible to decide that the fixing belt 21 is not rotated.

On the other hand, in a situation where the detected part 82 is rotated, i.e., in a situation where the fixing belt 21, cap member 81 and elastic member 34 are rotated, an optical path from the light emitting part 84 to the light receiving part 85 in the sensor 83 is sequentially opened/closed by the detected part 82, and then, the received light amount is sequentially switched between the High level and Low level. In such a case, it is possible to decide that the fixing belt 21 is rotated.

By applying such a configuration, it is possible to decide on the basis of a detection result of the sensor 83 whether or not the fixing belt 21 is rotated. Therefore, it is possible to avoid a situation where the fixing belt 21 without rotation is heated.

Third Embodiment

Figure 9:
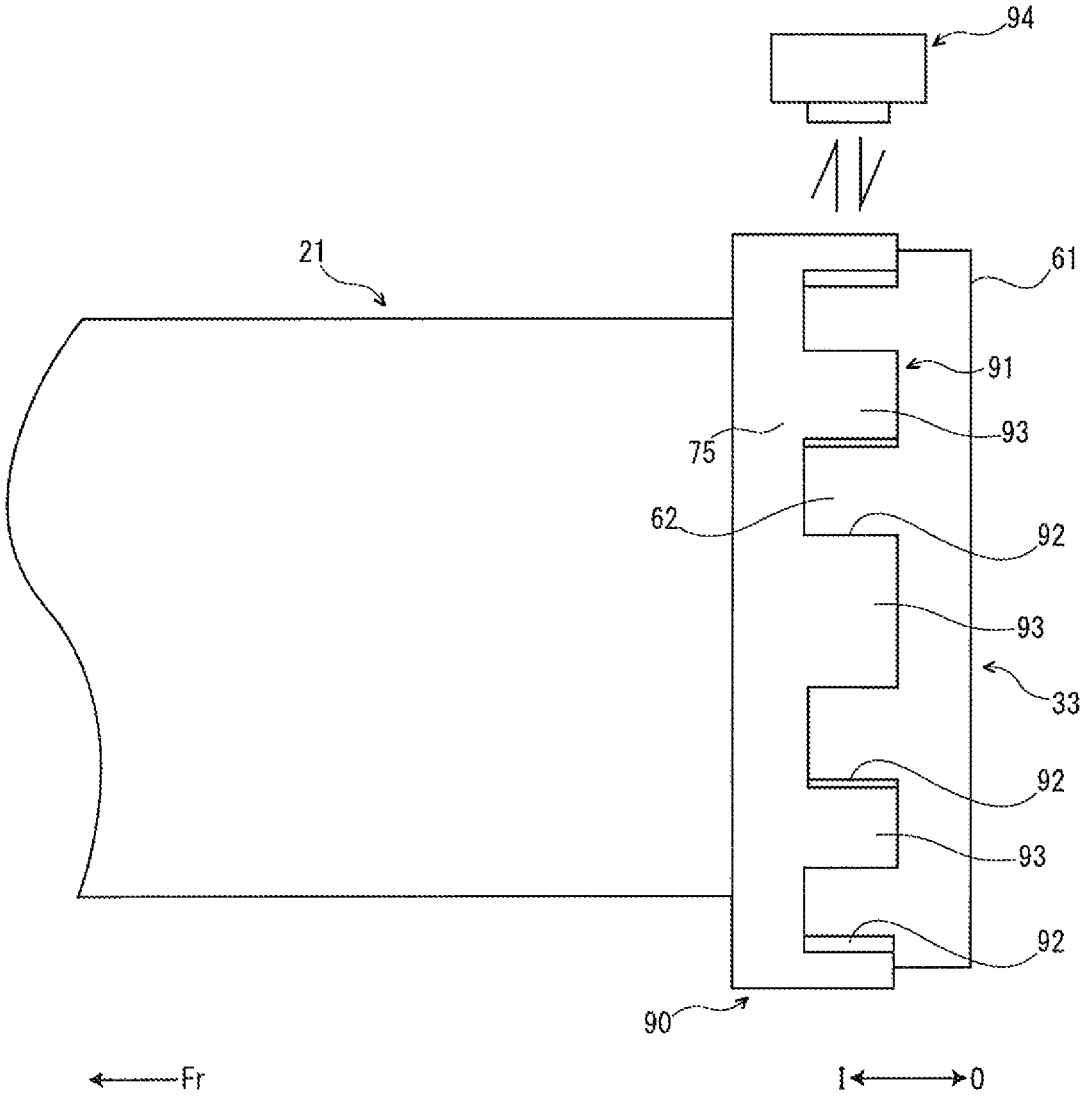
FIG. 9 is a side view showing the rear end part of the fixing belt and the periphery in the fixing device of the printer according to a third embodiment of the present disclosure.
Figure 10:
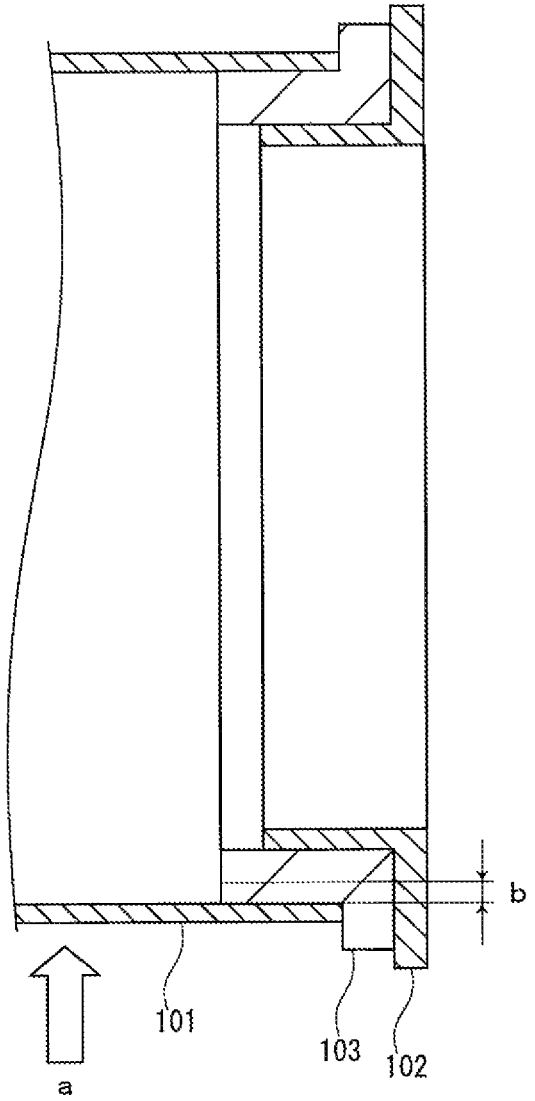
FIG. 10 Related Art
FIG. 10 is a side sectional view showing a configuration of a fixing device.
Figure 11:
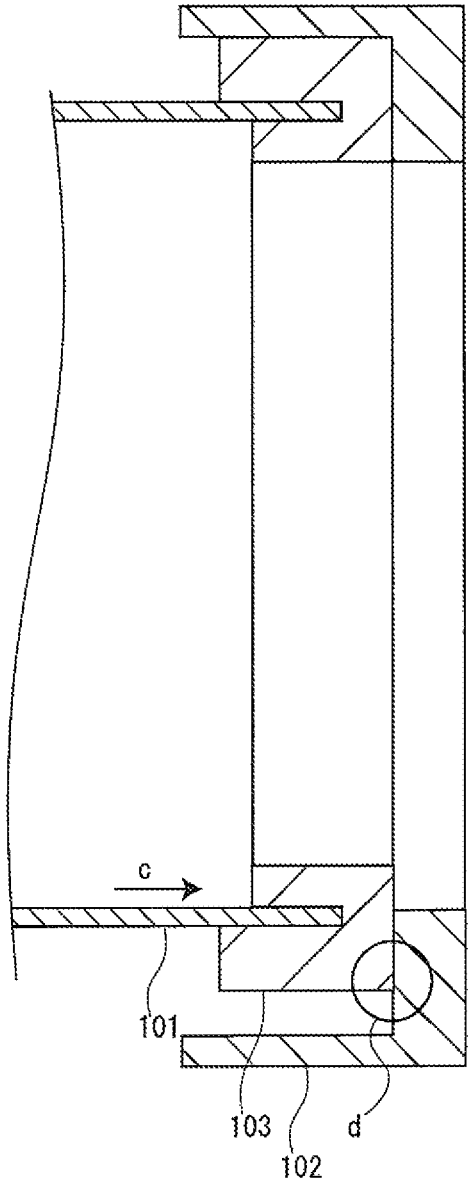
FIG. 11 Related Art
FIG. 11 is a side sectional view showing a configuration of another fixing device.

Next, the third embodiment of the present disclosure will be described with reference to FIG. 9. An arrow Fr in FIG. 9 indicates the front side of fixing device 18. An arrow I in FIG. 9 indicates the inside in forward and backward directions and an arrow O in FIG. 9 indicates the outside in the forward and backward directions. Since other components except for an elastic member 90 are configured in a similar way to the first embodiment, same reference numerals as the first embodiment are attached to the other components (particularly, in the figures) and the description of the other components is omitted. With regard to similar parts of the elastic member 90 to the elastic member 34 in the first embodiment, same reference numerals as the elastic member 34 are attached (particularly, in the figures) and the description is omitted.

In the fifth wall part 75 of the elastic member 90, a detected part 91 is arranged. The fifth wall part 75 of the elastic member 90 corresponds to the outer circumference part of the entire elastic member 90. In the detected part 91, a plurality of notched parts 92 and a plurality of non-notched parts 93 arranged at intervals of formation of the notched parts 92 are arranged alternately in a circumferential direction.

Above the fifth wall part 75 of the elastic member 90, a sensor 94 (a detecting part) is arranged. The sensor 94 is, for example, a reflection light type optical sensor to have a function detecting a distance to a detected object.

In a configuration as mentioned above, in a situation where the detected part 91 is not rotated, i.e., in a situation where the fixing belt 21, cap member 33 and elastic member 90 are not rotated, light from the sensor 94 continuously hits the non-notched part 93 of the detected part 91 or passes through the notched part 92 of the detected part 91 and continuously hits the flange part 62 of the cap member 33. Therefore, the distance from the sensor 94 to the detected object is kept constant. In such a case, it is possible to decide that the fixing belt 21 is not rotated.

On the other hand, in a situation where the detected part 91 is rotated, i.e., in a situation where the fixing belt 21, cap member 33 and elastic member 90 are rotated, the light from the sensor 94 hits the non-notched part 93 of the detected part 91 and the flange part 62 of the cap member 33 alternately. Therefore, the distance from the sensor 94 to the detected object is sequentially switched. In such a case, it is possible to decide that the fixing belt 21 is rotated.

By applying such a configuration, it is possible to decide on the basis of a detection result of the sensor 94 whether or not the fixing belt 21 is rotated. Therefore, it is possible to avoid a situation where the fixing belt 21 without rotation is heated.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt rotating around a rotation axis;

a pressuring rotation body coming into pressure contact with the fixing belt to form a fixing nip;

a cap member attached to an end part of the fixing belt, the cap member including a main body part covering outside in the rotation axis direction of the end part of the fixing belt, and a flange part extending from the main body part to inside in the rotation axis direction and covering an external diameter side of the end part of the fixing belt; and an elastic member interposed between the end part of the fixing belt and the cap member, the elastic member including a belt insertion part into which the end part of the fixing belt is inserted, a cap insertion part into which the flange part is inserted, the cap insertion part arranged at the external diameter side from the belt insertion part and a contact part arranged at the outside in the rotation axis direction from the belt insertion part and cap insertion part to come into contact with an internal side face in the rotation axis direction of the main body part;

wherein when the fixing belt is deformed to an internal diameter side, the elastic member is elastically deformed so as to make the belt insertion part moved to the internal diameter side with respect to the cap insertion part, and then, a gap is formed in at least a part between the internal side face in the rotation axis direction of the main body part and the contact part.

2. The fixing device according to claim 1, wherein the elastic member includes:

a first wall part extending in the rotation axis direction;

a second wall part bent from the first wall part to the internal diameter side;

a third wall part bent from the second wall part to the inside in the rotation axis direction;

a fourth wall part bent from the first wall part to the external diameter side; and a fifth wall part bent from the fourth wall part to the outside in the rotation axis direction, wherein the belt insertion part is formed so as to be surrounded by the first wall part, second wall part and third wall part, the cap insertion part is formed so as to be surrounded by the first wall part, fourth wall part and fifth wall part, the contact part is arranged on an outside face in the rotation axis direction of the second wall part.

3. The fixing device according to claim 1, wherein when the fixing belt is deformed to the internal diameter side, a gap is formed in at least a part between the belt insertion part and the end part of the fixing belt and a gap is formed in at least a part between the cap insertion part and the flange part.

4. The fixing device according to claim 1, wherein a rib is arranged in the internal side face in the rotation axis direction of the main body part.

5. The fixing device according to claim 4, wherein a plurality of the ribs are arranged radially around the rotation axis.

6. The fixing device according to claim 1 further comprising:

a detected part provided on an outer circumference part of the cap member; and a detecting part detecting rotation of the detected part.

7. The fixing device according to claim 1 further comprising:

a detected part provided on an outer circumference part of the elastic member; and a detecting part detecting rotation of the detected part.

8. The fixing device according to claim 1 further comprising:

a pressing member pressing the fixing belt to a side of the pressuring rotation body; and a supporting member supporting the pressing member.

9. The fixing device according to claim 1 further comprising:

a bias stopping member coming into contact with an outside face in the rotation axis direction of the main body part.

10. An image forming apparatus comprising:

a fixing device, wherein the fixing device includes:

a fixing belt rotating around a rotation axis;

a pressuring rotation body coming into pressure contact with the fixing belt to form a fixing nip;

a cap member attached to an end part of the fixing belt, the cap member including a main body part covering outside in the rotation axis direction of the end part of the fixing belt, and a flange part extending from the main body part to inside in the rotation axis direction and covering an external diameter side of the end part of the fixing belt; and an elastic member interposed between the end part of the fixing belt and the cap member, the elastic member including a belt insertion part into which the end part of the fixing belt is inserted, a cap insertion part into which the flange part is inserted, the cap insertion part arranged at the external diameter side from the belt insertion part and a contact part arranged at the outside in the rotation axis direction from the belt insertion part and cap insertion part to come into contact with an internal side face in the rotation axis direction of the main body part;

wherein when the fixing belt is deformed to an internal diameter side, the elastic member is elastically deformed so as to make the belt insertion part moved to the internal diameter side with respect to the cap insertion part, and then, a gap is formed in at least a part between the internal side face in the rotation axis direction of the main body part and the contact part.

11. The image forming apparatus according to claim 10, wherein the elastic member includes:

a first wall part extending in the rotation axis direction;

a second wall part bent from the first wall part to the internal diameter side;

a third wall part bent from the second wall part to the inside in the rotation axis direction;

a fourth wall part bent from the first wall part to the external diameter side; and a fifth wall part bent from the fourth wall part to the outside in the rotation axis direction, wherein the belt insertion part is formed so as to be surrounded by the first wall part, second wall part and third wall part, the cap insertion part is formed so as to be surrounded by the first wall part, fourth wall part and fifth wall part, the contact part is arranged on an outside face in the rotation axis direction of the second wall part.

12. The image forming apparatus according to claim 10, wherein when the fixing belt is deformed to the internal diameter side, a gap is formed in at least a part between the belt insertion part and the end part of the fixing belt and a gap is formed in at least a part between the cap insertion part and the flange part.

13. The image forming apparatus according to claim 10, wherein a rib is arranged in the internal side face in the rotation axis direction of the main body part.

14. The image forming apparatus according to claim 13, wherein a plurality of the ribs are arranged radially around the rotation axis.

15. The image forming apparatus according to claim 10, wherein the fixing device further includes:

a detected part provided on an outer circumference part of the cap member; and a detecting part detecting rotation of the detected part.

16. The image forming apparatus according to claim 10, wherein the fixing device further includes:

a detected part provided on an outer circumference part of the elastic member; and a detecting part detecting rotation of the detected part.

17. The image forming apparatus according to claim 10, wherein the fixing device further includes:

a pressing member pressing the fixing belt to a side of the pressuring rotation body; and a supporting member supporting the pressing member.

18. The image forming apparatus according to claim 10, wherein the fixing device further includes:

a bias stopping member coming into contact with an outside face in the rotation axis direction of the main body part.

* * * * *